United States Patent [19]

Parren

[11] Patent Number: 4,901,848

[45] Date of Patent: Feb. 20, 1990

[54] CASE FOR PERSONAL ACCESSORY ITEMS

[76] Inventor: Joseph R. Parren, 19638 N. 34th Dr., Phoenix, Ariz. 85027

[21] Appl. No.: 269,061

[22] Filed: Nov. 9, 1988

[51] Int. Cl.[4] ..... F23Q 25/00; A47G 29/10

[52] U.S. Cl. ..... 206/86; 431/253; 431/146; 431/129; 431/130

[58] Field of Search ..... 206/85–89, 206/385; 431/253, 146, 129, 130, 343, 344

[56] References Cited

U.S. PATENT DOCUMENTS

| | | | |
|---|---|---|---|
| 2,611,202 | 9/1952 | Lipic | 431/344 |
| 2,695,508 | 11/1954 | Gruber | 431/344 |
| 4,486,169 | 12/1984 | Lewis | 206/85 X |
| 4,553,926 | 11/1985 | Crespy | 206/86 X |
| 4,576,839 | 3/1986 | Parren | 206/87 X |
| 4,588,076 | 5/1986 | Caputo et al. | 206/86 |
| 4,625,861 | 12/1986 | Krog | 206/86 X |
| 4,634,374 | 1/1987 | Herko | 431/146 |
| 4,640,679 | 2/1987 | Perrin | 431/146 |
| 4,653,999 | 3/1987 | Dennis, Jr. et al. | 431/310 X |

FOREIGN PATENT DOCUMENTS

| | | | |
|---|---|---|---|
| 164076 | 9/1949 | Austria | 431/146 |
| 85139 | 5/1965 | France | 206/87 |
| 27125 | 2/1984 | Japan | 431/146 |
| 386153 | 4/1965 | Switzerland | 431/147 |

*Primary Examiner*—William Price

*Attorney, Agent, or Firm*—Gregory J. Nelson

[57] ABSTRACT

A case for personal accessory items such as disposable lighters, cosmetics and candy, packaged in elongate containers. In the preferred embodiment, a case having a transparent area slidably receives the accessory item. Suitable ornamentation is provided in the transparent area. A portion of the case extends to provide a shield or guard over the ignition components of the lighter to minimize the risk of inadvertent actuation when the lighter is fully inserted in the case. The body of the case may be provided with a relieved area so that the user can conveniently extend a part of the contained lighter from the case to a position of use.

12 Claims, 1 Drawing Sheet

12
20
22
70
10
18
76
58
JP
30
60

12
18
14
75
34
36
22
76
32
16
W
30
35

20
72
70
12
22
44
12
20
120
118
119

112
100
110
22
114
118

150
158
156
160
162
12
161
157
154

300
302
315
326
325

310
304
315
340
328

200
202
220
12
215

250
255
256
12
258

350
352

362
356
360
355
362
357

CASE FOR PERSONAL ACCESSORY ITEMS

The present invention relates to a case for personal accessories and more particularly relates to a case for articles such as cigarette lighters, lipsticks, lip balms and other cosmetics or personal items commonly provided the consumer in an elongate container.

Manufacturers of accessory and personal items such as cosmetics, cigarette lighters, lip balms, gum and candy often package such items in generally elongate, circular or oval containers which are often discarded after use. Typical of such a container construction is the design of disposable butane lighters. Lighters have gained wide acceptance because they are inexpensive, convenient to use and are disposable. Accordingly, lighters of this type have a body which is generally elongate, may be oval, round or rectangular in cross section. Lighters of this type are sold under various trademarks such as BIC and SCRIPTO.

Because of the rather ordinary appearance of these items, various decorative holders or cases can be found in the prior art. These cases are generally of uniform thickness and have a sleeve-like shape which extends about the lighter body and which are provided with some type of surface ornamentation or decoration. Typical of this type of holder is the type which has a metal sleeve carrying initials or other decorative surface ornamentation. Such holders have found limited acceptance due to their appearance or their expense. Further, items of this type serve only a decorative purpose providing no functional advantages to the user.

In addition to cigarette lighters, other items such as cosmetics, lip balms and even some consumable items such as candy and gum are provided to the consumer in elongate, cylindrical or oval packages. A particular problems exists in the case of candy and gum provided in such type of packages. Normally, as the product is removed, such as individual candies or mints, the exterior packaging is progressively peeled away reducing the length of the package. The removal of the packaging also often leaves the upper-most piece of candy or gum exposed. As the size of the package is reduced, it becomes more difficult to locate particularly if it is placed in a purse or handbag.

Accordingly, there exists a need in the art for an improved decorative case for items such as those described above which case can be manufactured inexpensively and which will serve to protect the contained item.

One particular type of decorative holder is disclosed in my prior patent, U.S. Pat. No. 4,576,839. This particular patent describes an ornamental holder for generally elongate articles such as disposable lighters, cosmetics and the like. The holder of my prior patent has a body with a front side which defines a transparent viewing window which receives a suitable design or ornamentation at the interior surface of the window. The window is configured as a lens to enhance the visual effect of the ornamentation when viewed from the exterior.

The present invention may be used in connection with disposable lighters and other types of items and articles described above and serves to protect the contained item and also provides a convenient way of advancing or extending the contained item from the case. Briefly, the present invention comprehends a case for generally elongate tubular, oval or similarly shaped articles which case defines an interior opening at least partially conforming to the cross sectional configuration of the article to be received so the article can either be slipped into the opening or snapped in place in the case. The contained article is longitudinally slidable relative to the case. The front surface of the case is preferably transparent so that appropriate ornamentation can be applied at a surface of the front side of the case. The ornamentation may consist of engraving, stamping, surface carving of ornamentation which preferably gives a three-dimensional effect. A surface of the viewing area is preferably curved or faceted to provide a lens effect to enhance and magnify the appearance of the ornamentation.

A portion of the side wall of the case may be cut out or relieved to expose a portion of the contained article so that the user may easily advance or extend the article from the case when the article is used. The embodiment of the case which is especially adapted to contain a disposable lighter has an upper edge with a projecting shield which extends at least to an area adjacent the gas valve lever of the lighter to minimize the possibility of inadvertent release of fuel from the lighter.

The above and other objects and advantages of the present invention will become more apparent from the following specification, claims, and drawings in which:

Figures 1, 2, 3, 4, 5, 6, 7, 8, 9, 10, 11, 12:
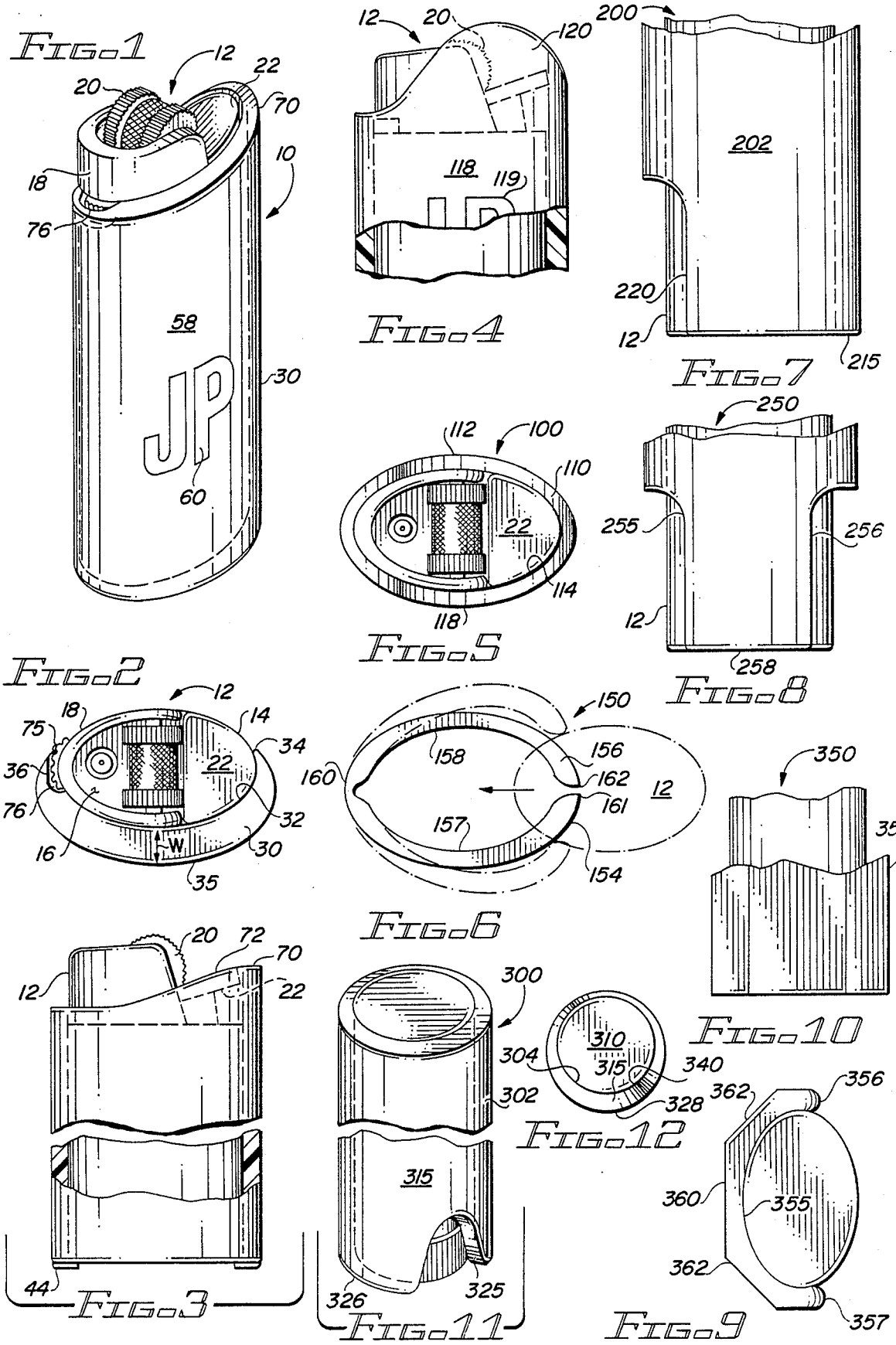
FIG. 1 is a perspective view of a preferred embodiment of a case constructed according to the present invention adapted for containment of a disposable lighter.
FIG. 2 is a top view of the holder of FIG. 1.
FIG. 3 is a side view of the holder of FIG. 1.
FIG. 4 is a side view of the top portion of an alternate embodiment of a case adapted for use with a disposable lighter.
FIG. 5 is a top view of the case of FIG. 4.
FIG. 6 is a top view of still another construction of the case of the present invention incorporating a living hinge.
FIG. 7 is a side view of the lower portion of a case constructed in accordance with the present invention provided with a cut-out or relieved section in the body.
FIG. 8 is another view of similar to FIG. 7 showing oppositely disposed cut-outs or recesses in the case body.
FIG. 9 is a top view of still another embodiment of the holder case of the present invention provided with surface facets.
FIG. 10 is a partial front view of the case shown in FIG. 9.
FIG. 11 is a perspective view of another embodiment of the case of the present invention for reception of generally cylindrical items.
FIG. 12 is a top view of the case of FIG. 11.

Turning now to the drawings, particularly FIGS. 1 to 3, the preferred embodiment of the present invention is shown which is generally designated by the numeral 10. Embodiment 10 is a case particularly adapted to receive a conventional disposable butane lighter 12. The lighter 12 is of conventional design and has an elongate body 14 having a generally exterior oval shape. Body 14 serves as a reservoir or well for fuel such as butane gas. The upper end of body 14 has a generally planar surface 16 on which is mounted a flame shield 18. Flint or striker wheel 20 extends transversely between opposite sides of the flame shield. Fuel release is controlled by gas valve lever 22 which typically is located adjacent the striker wheel and is generally upwardly inclined. The gas control lever 22 has an exterior configuration generally conforming to the exterior configuration of the portion of the lighter body immediately subjacent the lever. In some lighter constructions the gas control lever projects from the side of the body. The foregoing description of the lighter 12 is for purposes of illustration as the lighter construction forms no part of the present invention. The term "ignition device" is used to generally describe the fuel and/or ignitor controls of lighters of the general type.

One particular problem with lighters of this type is that the gas control lever 22 may be inadvertently depressed when the lighter is placed in a pocket or handbag causing release of the butane creating a hazardous situation in which the released gas may be inadvertently ignited. As will be explained, the case of the present invention has provision for shielding or protecting the gas control lever so that inadvertent actuation of the lever is minimized. To this end, case 10 has a generally elongate body portion 30 having an inner surface 32 which conforms in shape to a portion of the oval configuration of the body 14 of the lighter. Retaining members 34 and 36 extend at opposite sides of the body 30 of the case. The retaining members 34, 36 may extend and completely enclose the contained object or may simply extend rearwardly a sufficient distance to retain the object in position with a portion of the object being exposed at the rear of the holder as shown in FIG. 2. As shown, the opposite retaining members 34, 36 taper to smoothly form a transition to the exposed rear portion of the contained object.

The body of case 10 has a generally curved front surface 35 which, with the rear surface 32, defines a cross sectional configuration in which the body progressively increases in width from the distal ends of the projections 34 and 36 to an area of greatest width along a longitudinally central area designated by the letter "W". Preferably, at least the central portion of the body is transparent defining a viewing window extending the entire length of the body but to provide a substantial transparent viewing area for receipt of ornamentation. The transparent window area designated by the numeral 58 has at least one of its opposite surfaces 32, 35 curved so that the viewing window is in the form of a lens which enhances the visual effect of any ornamentation 60 applied at either surface 32 or 35 in the area of the viewing window.

The case described above may be formed as an integral unit as by extrusion, molding or may be formed from several pieces joined together by appropriate bonding techniques. Preferably, the holder is formed from a suitable transparent plastic such as Lucite plastic.

Appropriate decoration or ornamentation 60 is provided at the viewing window. In the simplest form the ornamentation may take the form of a business card or photograph which may be placed at surface 32 and held in place when the contained object is inserted into the holder. The viewing window appears as a lens which will protect the card or photograph and the lens characteristics will serve to enhance and dramatize the inserted card or photograph. Ornamentation may also take the place by engraving, stamping or surface carving applied to either of the surfaces 32 or 35 so the item may be decorated or personalized to the taste and preference of the individual. With the ornamentation on the interior surface 32, the exterior surface remains smooth and the ornamentation is protected from much of the wear imposed by usage.

The case of the present invention also serves to protect the lighter 12 from inadvertent actuation. This is accomplished through the configuration of the upper edge 70 of the holder. The upper edge 70 as shown in FIGS. 1 to 3 is contoured having a projection 72 which extends to form a protective shield in the area at least adjacent the gas control lever 22 when the lighter is fully inserted in the case, as best seen in FIG. 3. In this position the gas control lever is protected by the edge 70 to prevent inadvertent actuation of the gas control lever. With some lighter configurations this edge forming the shield will extend laterally from the body of the case to accomodate and shield the gas control lever.

Some disposable lighter configurations have a flame adjusting wheel 75 which projects slightly beyond the periphery of the case so that it can be manually adjusted by the user. To accomodate the wheel, a small recess 76 is provided at the interior surface of the holder in the area adjacent the wheel 75. Recess 76 also serves as a stop or a seat which prevents the lighter from being pushed or forced downwardly beyond the position shown in FIG. 3. In the event the lighter configuration does not include a wheel or other projection, a small flange 44 may be incorporated at the lower end of the body to serve as a stop for the lighter.

FIGS. 4 and 5 show another embodiment of the present invention generally designated by the numeral 100. In this embodiment, the case 100 is again adapted to house a conventional disposable gas lighter 12 which is received within the body 110 of case 100. Body 110 has an exterior surface 112 and an interior surface 114 closely conforming to the exterior configuration of the lighter so that the lighter may be conveniently inserted into the holder and manually moved longitudinally relative to the holder or case. Both the upper and lower ends of the case are open. With the embodiment 100 shown in FIGS. 4 and 5, the case completely encircles or extends around the lighter 12 and is preferably made from a suitable material such as a clear Lucite plastic. One section of the holder, which for purposes of reference is designated the "front", has at least one arcuate or curved surface 118 defining a lens which receives suitable ornamentation 119. The upper edge of the case is provided with an upwardly extending projection 120 which is generally curved and with the lighter in the fully inserted position shown in FIG. 4 extends above the gas control lever and the flint wheel 20 so these components are shielded from inadvertent actuation.

When it is desired to use the lighter, the user may simply grasp the exterior of the case and apply an upward force to the exposed bottom of the lighter to partially extend the lighter from the holder. This will cause the gas control lever 22 to move clear of the projection or shield 120 so that the lighter may be ignited. When use of the lighter has been completed, the user simply pushes the lighter downward returning the lighter to the protected position shown in FIG. 4.

FIG. 6 is a top view of another embodiment of the present invention generally designated by the numeral 150. In this embodiment, case 150 is adapted for containment of an article such as a disposable lighter 12, shown in phantom lines for clarity. Case 150 has front section 154 and a rear section 156 having interior surfaces 157, 158 respectively which define a generally oval opening adapted to snugly receive the contained article when in the closed position, shown in full lines. The sections 154 and 156 are joined at one edge ar a flexible hinge 160 which is often termed a "living hinge". The opposite distal ends 161 and 162 abut or nearly abut when the case is in the closed position shown in full lines.

The case may be made from any material such as a suitable plastic material and is preferably is transparent so that suitable ornamentation may be placed on an interior or exterior surface of the body and so that the lighter may be viewed through the case.

When it is desired to insert a lighter 12 which is represented in pnantom, the sections 154 and 156 may be separated a sufficient distance to allow the lighter to be inserted and when the sections are released will close through the action of the hinge 160 to snugly engage the lighter. The upper edge of the case 150 may be provided with a projection as shown in FIGS. 1 and 4 to shield the gas control lever when the lighter is fully inserted in the case.

FIG. 7 shows a lower portion of a lighter case 200 generally constructed as has been described with reference to FIGS. 1 through 5. Case 200 has a body 202 adapted to slidably and snugly receive a contained article such as a lighter 12. Case 200 is modified to conveniently facilitate the upward manual displacement of the contained lighter 12. To this end, a longitudinally extending recess 220 is provided in a body 202. Preferably recess 220 extends longitudinally upward from the planar bottom 215 of the body a suitable distance. For example, the typical holder for a disposable lighter will be approximately 2 ¾" in length in which case the recess or cut-out area 220 extends upwardly approximately one inch. Thus the user would grasp the lighter case with the fingers and thumb of the hand and place the thumb of the other hand against the exposed portion of the contained article at the recess 220. Upward force can be applied in this manner which will displace the lighter upwardly moving rt a sufficient distance to release the gas control lever from the shield area at the upper edge of the case so the lighter can be actuated.

In FIG. 8 another embodiment 250 is illustrated. The case 250 is constructed as described above to receive an article such as a lighter 12. Case 250 is provided with oppositely disposed relieved areas 255 and 256 which extend upwardly from the bottom edge 258 to expose lower portions of the lighter at opposite sides of the case. Upward manual displacement of the lighter 12 may be easily accomplished by grasping the case in either the right or the left hand and applying an upward force to the lighter with the thumb.

FIGS. 9 and 10 shown another embodiment of the case generally designated by the numeral 350. In this embodiment, the case has a body 352 which has an inner surface 355 which is curved and generally elongate to snugly receive at least a portion of the body of the contained item such as a conventional butane lighter. Retaining members 356 and 357 extend at opposite sides of the body to engage the contained object. Preferably the case is generally transparent as has been described above so that the contained object and any ornamentation applied at the inner surface may be visible. The holder is preferably formed as an integral unit by extruding or similar techniques. The upper edge of the case is formed having a projection as shown in FIGS. 1 and 4 which serves as a shield for the gas control lever of the contained lighter. The exterior surface 360 is formed having a series of longitudinally extending flattened surfaces or facets 362 which add to the aesthetic appeal of the device.

FIGS. 11 and 12 show another embodiment of the case of the present invention generally designated by the numeral 300. In this embodIment, the case 300 is in the form of a sleeve defining a generally cylindrical longitudinally extending opening 304 adapted to house or contain a generally cylindrical article 310. Article 310 may typically be a cosmetic container such as a lipstick, a lip balm or even candy or mints packaged in cylindrical form. Housing 302 is preferably of a plastic material having at least a window area 315 which is transparent. Window 315 is shown having opposite curved surfaces 328 and 340 which define a lens that enhances any decoration or ornamentation that may be applied to the interior surface of the body in the area of the viewing window or which may appear on the contained article. A cut out or recess 325 extends longitudinally upward from the bottom edge 326 of the case. The contained article 310 can be conveniently manually extended from the housing by manual force applied at recess 325.

Thus, the case of the present invention is adapted to be used with a wide variety of items such as disposable lighters, cosmetic items and food items. The device may receive ornamentation either on an inner surface or an exterior surface which ornamentation is decorative and enhances the appearance of the enclosed object. The overall shape of the case provides good tactile feel and in many cases makes use of the contained item or article more convenient and sanitary. The case serves to protect the contained item and with a contained item such as a cigarette lighter, receives the lighter in a position to prevent inadvertent actuation of the gas valve to provide protection.

It will be apparent to those skilled in the art to make various changes, alterations and modifications to the case described herein. To the extent that these various alterations, modifications and changes do not depart from the spirit and scope of the appended claims, they are intended to be encompassed therein.

I claim:

1. A case for a disposable gas lighter of the type having a body with a gas control lever, flint wheel and flame adjustment wheel thereon, said case comprising:

(a) a generally longitudinal body having a front section and opposite sides and a top and bottom edge defining a longitudinal opening extending from the said top to the bottom edges adapted to slidably receive the lighter therein; and (b) said body being configured having a shield thereon extending to at least correspond to the position of the gas control lever with the lighter fully inserted in the opening to minimize inadvertent actuation of the gas valve lever.

2. The case of claim 1 wherein said body is plastic and at least a portion thereof defines a transparent viewing window.

3. The case of claim 2 wherein said transparent viewing window is curved to form a lens.

4. The case of claim 3 wherein said body is provided with ornamentation at said lens.

5. The case of claim 1 wherein said body is provided with a plurality of facets on said front section.

6. The case of claim 5 wherein said body defines a relieved area exposing at least a portion of the contained lighter when the lighter is fully inserted therein whereby the lighter may be manually moved relative to said body to an operative position by application of manual force to said lighter at said relieved area.

7. The case of claim 1 wherein said case fully extends about the circumference of the said lighter.

8. A case for a gas lighter of the type having a body with an ignition device thereon, said case comprising:

(a) a generally longitudinal body having a front section and opposite sides and a top and bottom edge defining a longitudinal opening extending from the said top to the bottom edges adapted to slidably receive the lighter therein; and (b) said body being configured having a shield thereon extending to at least correspond to the position of the ignition device with the lighter fully inserted in the opening to minimize inadvertent actuation of the ignition device.

9. The case of claim 8 wherein said body is plastic and ar least a portion thereof defines a transparent viewing window.

10. The case of claim 8 wherein said body defines a relieved area exposing at least a portion of the contained lighter when the lighter is fully inserted therein whereby the lighter may be manually moved relative to said body to an operative position by application of manual force to said lighter at said relieved area.

11. A case for a generally elongate object having a body with a top and bottom surface including actuation means at said top surface of said object, said case comprising:

(a) a generally longitudinal body having a front section, opposite sides and a top and bottom edge, said body defining a longitudinal opening extending from said top edge to said bottom edge adapted to receive the object therein whereby the object is slidable relative to said body between non-use position with the object fully inserted in said body and an extended use position; and (b) said body being configured having a shield associated with the top edge thereof, said shield extending to at least a position corresponding to the position of the actuation means at opposite sides of said body when the object is fully inserted in the opening to laterally shield the actuation means from an inadvertent actuation in the non-use position.

12. The case of claim 1 wherein said body includes a living hinge member whereby said body may be opened to admit the said lighter therein.

* * * * *